US006758727B2

(12) United States Patent
Coad

(10) Patent No.: US 6,758,727 B2
(45) Date of Patent: Jul. 6, 2004

(54) ABRASIVE ARTICLE AND METHODS OF MANUFACTURING AND USE OF SAME

(75) Inventor: Eric C. Coad, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/313,233

(22) Filed: Dec. 6, 2002

(65) Prior Publication Data

US 2003/0134577 A1 Jul. 17, 2003

Related U.S. Application Data

(62) Division of application No. 09/657,401, filed on Sep. 8, 2000.

(51) Int. Cl.[7] ..... B24B 1/00

(52) U.S. Cl. ..... 451/41; 451/42; 451/57; 451/28; 51/295; 428/290

(58) Field of Search ..... 451/41, 57, 37, 451/60, 43, 44, 270, 290, 28, 42, 49, 59, 296, 299, 390, 365, 366, 384; 428/147, 283, 290; 51/295, 298, 309

(56) References Cited

U.S. PATENT DOCUMENTS

| | | | | |
|---|---|---|---|---|
| 3,997,302 A | | 12/1976 | Supkis | |
| 4,078,340 A | | 3/1978 | Klecker et al. | |
| 4,425,375 A | | 1/1984 | Abramson | |
| 4,623,364 A | | 11/1986 | Cottringer et al. | |
| 4,652,274 A | | 3/1987 | Boettcher et al. | |
| 4,720,941 A | | 1/1988 | Belieff et al. | |
| 4,744,802 A | | 5/1988 | Schwabel | |
| 4,770,671 A | | 9/1988 | Monroe et al. | |
| 4,881,951 A | | 11/1989 | Monroe et al. | |
| 4,903,440 A | | 2/1990 | Kirk et al. | |
| 4,905,415 A | | 3/1990 | Moulin | |
| 5,061,294 A | | 10/1991 | Harmer et al. | |
| 5,137,542 A | | 8/1992 | Buchanan et al. | |
| 5,185,966 A | | 2/1993 | Mock, Jr. et al. | |
| 5,193,133 A | | 3/1993 | Schofield et al. | |
| 5,203,884 A | | 4/1993 | Buchanan et al. | |
| 5,236,472 A | | 8/1993 | Kirk et al. | |
| 5,378,252 A | | 1/1995 | Follensbee | |
| 5,447,464 A | * | 9/1995 | Franklin et al. | 451/28 |
| 5,500,273 A | * | 3/1996 | Holmes et al. | 428/147 |
| 5,551,959 A | | 9/1996 | Martin et al. | |

(List continued on next page.)

FOREIGN PATENT DOCUMENTS

| | | |
|---|---|---|
| EP | 0 206 669 A2 | 12/1986 |
| EP | 0 535 636 A2 | 4/1993 |
| EP | 0 715 194 A2 | 6/1996 |
| EP | 0 729 047 A2 | 8/1996 |
| EP | 0 729 047 A3 | 1/1997 |
| EP | 0 860 722 A2 | 8/1998 |
| JP | 9-248771 | 9/1997 |
| JP | 10-71572 | 10/1998 |
| JP | 10-277957 | 10/1998 |
| JP | 11-333731 | 12/1999 |
| JP | 11-333732 | 12/1999 |
| WO | WO 97/11484 | 3/1997 |
| WO | WO 99/24221 | 5/1999 |

*Primary Examiner*—Lee D. Wilson
*Assistant Examiner*—Anthony Ojini
(74) *Attorney, Agent, or Firm*—Colene H. Blank

(57) ABSTRACT

The present invention provides an abrasive article formed of a binder, abrasive particles associated with the binder, and a lubricating particulate additive comprising polytetrafluoroethylene associated with the binder. The abrasive article of the invention is useful in the polishing of fiber optic connectors because the lubricating particulate additive allows the polishing rate of the softer glass fiber material to be slower than the polishing rate of the harder ceramic ferrule material. Methods of manufacture and methods of polishing a fiber optic connector is also provided.

20 Claims, 1 Drawing Sheet

U.S. PATENT DOCUMENTS 5,557,696 A 9/1996 Stein
5,560,753 A 10/1996 Schnabel et al.
5,667,426 A * 9/1997 Minami et al. ..... 451/41
5,778,125 A 7/1998 Busse et al.
5,855,503 A 1/1999 Csipkes et al.
5,908,477 A 6/1999 Harmer et al.
6,106,368 A 8/2000 Childers et al.
6,217,252 B1 4/2001 Tolliver et al.
6,217,432 B1 4/2001 Woo
6,258,138 B1 7/2001 DeVoe et al.
6,277,160 B1 8/2001 Stubbs et al.
6,325,752 B1 * 12/2001 Tomihashi et al. ..... 524/436

* cited by examiner

ABRASIVE ARTICLE AND METHODS OF MANUFACTURING AND USE OF SAME

CROSS REFERENCE TO RELATED APPLICATIONS

This application is a divisional of U.S. Ser. No. 09/657,401, filed Sep. 8, 2000, now pending, the disclosure of which is herein incorporated by reference.

BACKGROUND OF THE INVENTION

1. Field of the Invention

This invention relates to an abrasive article comprising a lubricating particulate additive, and to methods for the manufacture and use of such an article. The article is useful as a polishing film for polishing the exposed ends of a fiber optic connector, for example.

2. Description of the Related Art

Fiber optic connectors of a wide variety of designs have been employed to terminate optical fiber cables and to facilitate the connection of the cables to other cables or other optical fiber transmission devices. A typical optic fiber connector includes a ferrule, which mounts and centers an optical fiber or fibers within the connector. The ferrule may be fabricated of ceramic materials.

A single mode fiber optical connector includes a glass core with an outer diameter of about 9 microns surrounded by a glass cladding with an outer diameter of about 125 microns (collectively the "glass fiber"). A ceramic ferrule surrounds the glass fiber. The ceramic ferrule has an outer diameter of about 2.0 millimeters at its outer ends and the diameter increases along a beveled edge (approximately 45°) to about 2.5 millimeters at its widest portion. During manufacture, the glass fiber is threaded through the ceramic ferrule and attached with an epoxy resin. The excess glass is then cleaved from the newly formed fiber optical connector, and the ends are polished to a fine finish.

A pair of fiber optic connectors or a connector and another optical fiber transmission device often are mated in an adapter which centers the fibers to provide good transmission. The adapter couples the connectors together so that their encapsulated fibers connect end-to-end to permit the transmission of light. The adapter may be an in-line component, or the adapter can be designed for mounting in an opening in a panel, backplane, circuit board or the like.

The polishing of the connectors is a necessary and important step. The light travels through the glass fiber across the junction to the next connector. In order to achieve a good crossover of the light, the ends must be highly polished, and the polished ends of the glass fiber and the ceramic ferrule preferably lay within a common planar or slightly convex surface. A planar or slightly convex surface with a radius of curvature of between about 10 millimeters and about 20 millimeters gives maximum glass fiber contact area with the glass fiber in the adjacent connector. With good transmission of light across the junction, the backreflection of the connection, a measure of the amount of light lost across the junction, will be minimized.

The causes of backreflection at the junction between two joined fiber optic connectors are many. Among the causes are microscopic imperfections on and just below the surfaces of the polished ends of the fiber optic connector fibers. These imperfections can range from surface scratches to subsurface fractures caused by the grinding and polishing process itself. Another cause of backreflection arises from the fact that the ends of the joined fiber optic connectors are pressed and held together within their connectors with a specified force, usually about two (2) pounds. This force acts to compress the glass material of the fibers at their ends, creating an increasing molecular density gradient and thus an increasing optical index of refraction as light approaches the junction. This is especially a problem if the glass fiber protrudes beyond the ceramic ferrule. The increased index of refraction in the region of the junction causes some of the light to be reflected back from the junction, resulting in backreflection. Another potential cause of backreflection is the presence of a space between the ends of two glass fibers if they are not completely flush with one another. This problem arises when the glass fiber is recessed within the ceramic ferrule. Even though polishing techniques have improved, manufacturers have been unable to overcome these and other causes of backreflection.

Generally, polishing films abrade different materials at different rates. In optical connectors, the glass fiber typically abrades at a rate faster than the harder ceramic ferrule. This results in an unacceptable undercut, where the glass fiber is abraded below the outer end surface of the ceramic ferrule after polishing. In order to achieve good cross over of light, the undercut is preferably about no more than 50 nanometers, and more preferably much less than 50 nanometers.

It is desirable to overcome the shortcomings of prior polishing articles and methods and to create a process that will polish fiber optic connectors to provide a high polish on the glass fiber and an essentially planar or slightly convex (radius of curvature of between about 10 millimeters and about 20 millimeters) end surface (e.g. with low undercut values). It is also desirable to provide an article for use in such a process and a process for the manufacture of such an article.

SUMMARY OF THE INVENTION

The present invention provides an abrasive article, which comprises a backing having a surface. The surface is covered with a coating formed of a binder, abrasive particles associated with the binder, and a lubricating particulate additive comprising polytetrafluoroethylene associated with the binder. The article is useful in the polishing of fiber optic connectors because the lubricating particulate additive allows the polishing rate of the softer glass fiber material to be slower than the polishing rate of the harder ceramic ferrule material. The different polishing rates allow both materials to be polished in the same step using the same abrasive article to provide an acceptable polished surface.

Another aspect of the invention is a method of polishing a fiber optic connector having a contact surface. The method comprises a pre-polishing step comprising contacting the fiber optic connector contact surface with a first abrasive article and relatively moving the fiber optic connector and the first abrasive article. The method additionally includes a polishing step involving contacting the fiber optic connector contact surface with a polishing abrasive article comprising a backing having a surface and a coating on the surface. The coating comprises a binder, abrasive particles associated with the binder, and a lubricating particulate additive associated with the binder. The next step in the method involves relatively moving the fiber optic connector and the polishing abrasive article. Optionally, an additional pre-polishing step may be performed between the pre-polishing step and the polishing step, wherein the fiber optic connector contact surface is contacted with a second abrasive article and relatively moved with respect to the second abrasive article, the second abrasive article being different from the first abrasive article.

A third aspect of the invention is a method of manufacturing an abrasive article comprising spreading a flowable coating solution on a backing and solidifying the coating solution to provide the abrasive article. The coating solution is formed of a binder, abrasive particles, and a lubricating particulate additive comprising polytetrafluoroethylene. The coating solution is solidified. The coating solution may be solidified by any method known in the art, such as exposure to heat in an oven for a specified dwell time.

Throughout this application, the following definitions apply unless otherwise defined in the specification:

"Lubricating particulate additive" refers to a non-metallic material, which is substantially solid at room temperature.

"Wax" refers to an organic semi-crystalline solid.

"Protrusion" refers to the average distance between the glass fiber end surface and a virtual spherical surface fitted to a spherically polished ceramic ferrule if the glass fiber protrudes from the end surface of the ceramic ferrule. Protrusion is shown with a positive number.

"Undercut" refers to the average distance between the glass fiber end surface and a virtual spherical surface fitted to a spherically polished ceramic ferrule if the glass fiber is recessed within the ceramic ferrule. Undercut is shown with a negative number.

"Flowable" in reference to coating compositions herein, refers to material that can be spread across a surface using any of a variety of coating methods such as knife coating, for example.

"Backreflection" refers to a measurement of the reflection of light at a planar junction of two materials having different refractive indices. As used herein, it is generally the measure of light reflection through the junction of two fiber optic connectors.

Backreflection is specified and measured in decibels (dB) and is calculated as follows:

$$10 \log_{10}(P_{reflected}/P_{in})$$

Where $P_{reflected}$ is the optical power reflected at the junction between two mated connectors and $P_{in}$ is the optical power that enters the junction between the two connectors. Thus, a connector with a more negative backreflection transfers more signal from one cable to another and reflects less back as backreflection.

DETAILED DESCRIPTION OF THE INVENTION

Figure 1:
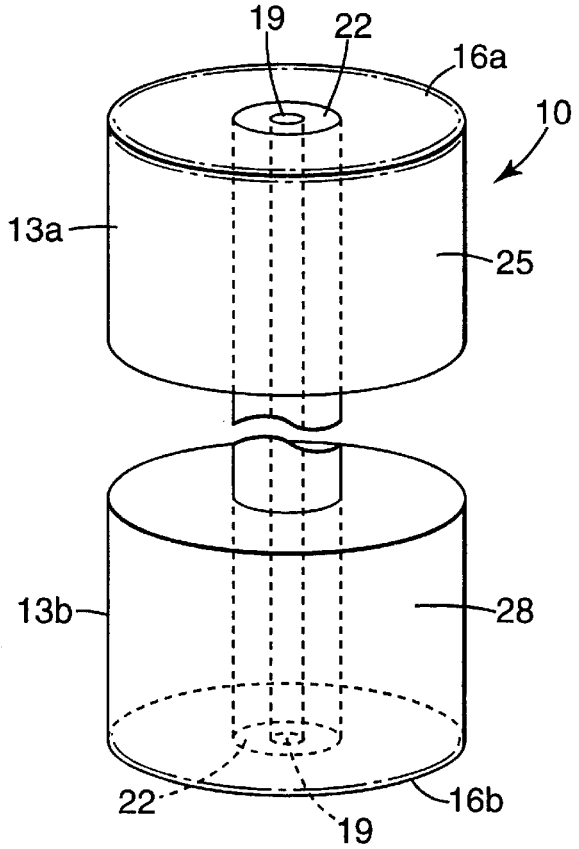
FIG. 1 is an elevated view in schematic, of a fiber optic cable having a fiber optic connector on either end, with the glass cladding and core shown in phantom through the ceramic ferrule.
Figure 2:
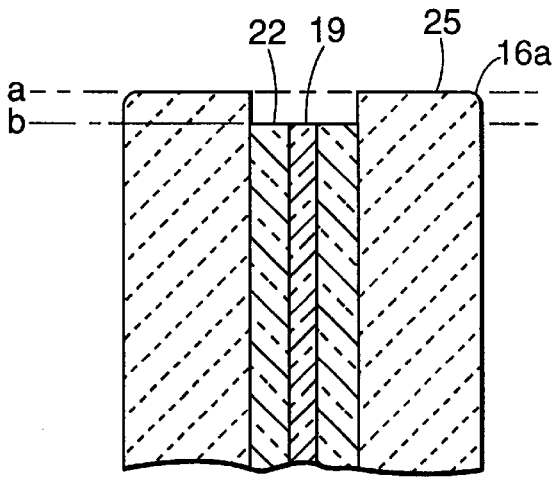
FIG. 2 is a cross sectional view of a fiber optic connector with an undercut.
Figure 3:
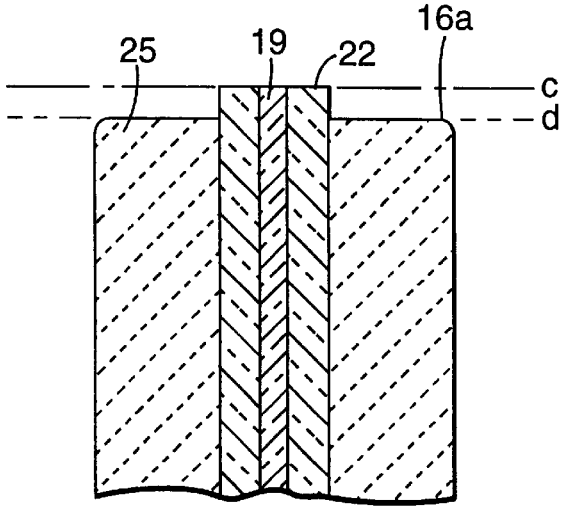
FIG. 3 is a cross sectional view of a fiber optic connector with a protrusion.

Before polishing, fiber optic connectors typically exhibit some degree of protrusion or undercut. FIG. 1 depicts a fiber optic cable 10. The fiber optic cable 10 has two ends, with fiber optic connectors 13*a* and 13*b* on either end. The fiber optic connectors 13*a* and 13*b* have contact surfaces 16*a* and 16*b*. Glass core 19 extends through the fiber optic cable 10 from contact surface 16*a* to contact surface 16*b*. The glass core 19 is surrounded by a glass cladding 22, which also extends through the fiber optic cable 10. A ceramic ferrule 25, which forms the exterior of the fiber optic connector 13*a*, surrounds the glass cladding 22. Similarly, a second ceramic ferrule 28 surrounds the glass cladding 22 near contact surface 16*b* to form the exterior of fiber optic connector 13*b*. FIG. 2 depicts a cross section of an embodiment of the fiber optic connector 13*a*, where the ends of the glass core 19 and the glass cladding 22 define plane surface b which is shown as being recessed within the ceramic ferrule 25. The contact surface 16*a* is shown as laying within plane surface a. FIG. 2 illustrates undercut where the end of the glass core 19 and cladding 22 lay recessed within the body of the ceramic ferrule 25 such that plane b is, in part, within the body of ceramic ferrule 25. FIG. 3 depicts a cross section of an embodiment of the fiber optic connector 13*a*, where the ends of the glass core 19 and the glass cladding 22 define plane surface c, and are protruding from the ceramic ferrule 25. The contact surface 16*a* of ceramic ferrule 25 is shown as laying within plane surface d. FIG. 3 illustrates protrusion, where the end of the glass core 19 and the glass cladding 22 protrude past the contact surface 16*a* of ceramic ferrule 25 such that plane c is wholly separated from the ceramic ferrule 25. Preferably, the contact surface 16*a* is planar or slightly convex to thereby provide the maximum surface area of the glass fiber for contact with a second glass fiber without exerting too much pressure against the second glass fiber, to achieve a good joint.

It is desirable for a polishing technique to give protrusion/undercut values within a range of about ±50 nanometers. More preferred is having a protrusion/undercut of about ±30 nanometers, most preferably about ±25 nanometers. Protrusion and undercut values close to zero provide maximum connection of the contact surfaces when assembling two connectors. However, polishing the contacts surfaces of optical connectors has proven challenging, as the glass and the ceramic each have different hardnesses and, consequently, experience different polishing rates when polished with a single abrasive article. These variations in polishing rates between the glass fiber and the ceramic ferrule frequently have resulted in excessive undercut following a polishing operation.

In one aspect, the invention provides an abrasive article suitable for use as a polishing film for modifying a surface formed of two materials having different hardness such as the contact surfaces of fiber optic connectors, for example. It has been surprisingly found that adding a lubricating particulate additive to the construction of the abrasive article slows the polishing rate of the softer material to substantially match the polishing rate of the harder material. The article of the invention comprises a backing and a coating on the backing. The coating comprises a hardened binder, abrasive particles associated with the binder, and a lubricating particulate additive also associated with the binder. The coating thickness is typically less than about 13 microns, preferably less than about 7 microns. The abrasive particles may be bound, adhered to, and/or dispersed throughout the binder. The backing may be of any material, preferably a flexible polymeric film. The backing may have a thickness of about 25 microns to about 178 microns. Preferably the backing has a thickness of about 50 microns to about 130 microns, most preferably about 75 to about 77 microns. Suitable backings include polyester films such as those described in the Examples herein. These backings include Backing 1, a primed 3 mil polyester backing prepared according to the teachings of European published application EP 206669A;

and Backing 2, a primed 3 mil polyester backing commercially available from Teijin America of Atlanta, Ga. under the trade designation Teijin SG2.

Binders

The binder used in the article of the invention may be any material used to form a film. Preferably, the binder is an organic binder formed from a coating solution. The coating solution is typically in a flowable state. During the manufacture of the abrasive article, the coating solution is then converted to a hardened binder in the manufactured abrasive article. The binder is typically in a solid, non-flowable state in the manufactured abrasive article. The binder can be formed from a thermoplastic material. Alternatively, the binder can be formed from a material that is capable of being crosslinked. It is also within the scope of this invention to have a mixture of a thermoplastic binder and a crosslinked binder. During the process of making the abrasive article, the coating solution is exposed to the appropriate conditions to solidify the binder. For crosslinkable coating solutions, the coating solution is exposed to the appropriate energy source to initiate the polymerization or curing and to form the binder. Thus after curing, the coating solution is converted into a binder.

The coating solution is preferably an organic material that is capable of being crosslinked. The preferred binder's coating solution can be either a condensation curable resin or an addition polymerizable resin. The addition polymerizable resins can be ethylenically unsaturated monomers and/or oligomers. Examples of useable crosslinkable materials include phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, or mixtures thereof.

Condensation Curable Resins

Phenolic resins are widely used in abrasive article binder because of their thermal properties, availability, cost and ease of handling. There are two types of phenolic resins, resole and novolac. Resole phenolic resins have a molar ratio of formaldehyde to phenol, of greater than or equal to one, typically between 1.5:1.0 to 3.0:1.0. Novolac resins have a molar ratio of formaldehyde to phenol, of less than to one to one. Examples of commercially available phenolic resins include those known by the tradenames "Durez" and "Varcum" from Occidental Chemicals Corp.; "Resinox" from Monsanto; "Arofene" from Ashland Chemical Co. and "Arotap" from Ashland Chemical Co.

Latex Resins

Examples of latex resins that can be mixed with the phenolic resin to include acrylonitrile butadiene emulsions, acrylic emulsions, butadiene emulsions, butadiene styrene emulsions and combinations thereof. These latex resins are commercially available from a variety of different sources including: "Rhoplex" and "Acrylsol" commercially available from Rohm and Haas Company, "Flexcryl" and "Valtac" commercially available from Air Products & Chemicals Inc., "Synthemul" and "Tylac" commercially available from Reichold Chemical Co., "Hycar" and "Goodrite" commercially available from B.F. Goodrich, "Chemigum" commercially available from Goodyear Tire and Rubber Co., "Neocryl" commercially available from ICI, "Butafon" commercially available from BASF and "Res" commercially available from Union Carbide.

Epoxy Resins

Epoxy resins have an oxirane ring and are polymerized by the ring opening. Such epoxide resins include monomeric epoxy resins and polymeric epoxy reins. These resin can vary greatly in the nature of their backbones and substituent groups. For example, the backbone may be of any type normally associated with epoxy resins and substituent groups thereon can be any group free of an active hydrogen atom that is reactive with an oxirane ring at room temperature. Representative examples of acceptable substituent groups include halogens, ester groups, ether groups, sulfonate groups, siloxane groups, nitro groups and phosphate groups. Examples of some preferred epoxy resins include 2,2-bis[4-(2,3-epoxypropoxy)-phenyl)propane (diglycidyl ether of bisphenol a)] and commercially available materials under the trade designation "Epon 828", "Epon 1004" and "Epon 1001F" available from Shell Chemical Co., "DER-331", "DER-332" and "DER-334" available from Dow Chemical Co. Other suitable epoxy resins include glycidyl ethers of phenol formaldehyde novolac (e.g., "DEN-431" and "DEN-428" available from Dow Chemical Co.

Ethylenically Unsaturated Coating Solutions

Examples of ethylenically unsaturated coating solutions include aminoplast monomer or oligomer having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions or mixtures thereof The aminoplast coating solutions have at least one pendant alpha, beta-unsaturated carbonyl group per molecule or oligomer. These materials are further described in U.S. Pat. Nos. 4,903,440 and 5,236,472, both incorporated herein after by reference.

The ethylenically unsaturated monomers or oligomers may be monofunctional, difunctional, trifunctional or tetrafunctional or even higher functionality. The term acrylate includes both acrylates and methacrylates. Ethylenically unsaturated coating solutions include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryl-oxyethyl) isocyanurate, 1,3,5-tri(2-methyacryloxyethyl)-s-triazine, acrylamide, methylacrylamide, N-methyl-acrylamide, N,N-dimethylacrylamide, N-vinyl-pyrrolidone, and N-vinyl-piperidone.

Isocyanurate derivatives having at least one pendant acrylate group and isocyanate derivatives having at least one pendant acrylate group are further described in U.S. Pat. No. 4,652,274, incorporated herein after by reference.

Acrylated urethanes are diacrylate esters of hydroxy terminated isocyanate extended polyesters or polyethers. Examples of commercially available acrylated urethanes include "UVITHANE 782", available from Morton Chemical, and "CMD 6600", "CMD 8400", and "CMD 8805", available from UCB Radcure Specialties. Acrylated epoxies are diacrylate esters of epoxy resins, such as the diacrylate esters of bisphenol A epoxy resin. Examples of commercially available acrylated epoxies include "CMD 3500", "CMD 3600", and "CMD 3700", available from UCB Radcure Specialties.

Acrylated urethanes are diacrylate esters of hydroxy terminated NCO extended polyesters or polyethers. Examples commercially available acrylated urethanes include UVITHANE 782, available from Morton Thiokol Chemical, and CMD 6600, CMD 8400, and CMD 8805, available from Radcure Specialties.

Acrylated epoxies are diacrylate esters of epoxy resins, such as the diacrylate esters of bisphenol A epoxy resin. Examples of commercially available acrylated epoxies include CMD 3500, CMD 3600, and CMD 3700, available from Radcure Specialties.

Examples of ethylenically unsaturated diluents or monomers can be found in U.S. Pat. No. 5,236,472 (Kirk et al.) and U.S. Ser. No. 08/144,199 (Larson et al.); the disclosures of both are incorporated herein after by reference. In some instances these ethylenically unsaturated diluents are useful because they tend to be compatible with water.

Additional details concerning acrylate dispersions can be found in U.S. Pat. No. 5,378,252 (Follensbee), incorporated herein after by reference.

It is also within the scope of this invention to use a partially polymerized ethylenically unsaturated monomer in the coating solution. For example, an acrylate monomer can be partially polymerized and incorporated into the abrasive slurry. The degree of partial polymerization should be controlled such that the resulting partially polymerized ethylenically unsaturated monomer does not have an excessively high viscosity so that the resulting abrasive slurry can be coated to form the abrasive article. An example of an acrylate monomer that can be partially polymerized is isooctyl acrylate. It is also within the scope of this invention to use a combination of a partially polymerized ethylenically unsaturated monomer with another ethylenically unsaturated monomer and/or a condensation curable binder.

In the present invention, suitable binders include a solid phenoxy resin having the trade designation of YP-50S obtained from Tohto Kasei Co. Ltd., Inabata America Corporation, New York, N.Y. which is then dissolved at 30% solids in 2-butanone prior to use herein. Also suitable are an isocyanate resin having a trade designation of CB55N from Bayer Corporation of Pittsburgh, Pa. and a polyester urethane resin prepared from 6% by weight neopentyl glycol, 31% by weight 4,4'-diphenyl methane diisocyanate (MDI), and 63% by weight poly-$\epsilon$-caprolactone in 2-butanone. In a specific embodiment, the binder comprises a combination of phenoxy resin, isocyanate resin and polyester urethane resin. Most preferably, the combination comprises about 33% (wet weight) to about 100% (wet weight) phenoxy, about 0% (wet weight) to about 34% (wet weight) isocyanate and about 0% (wet weight) to about 50% (wet weight) polyester urethane.

The above mentioned examples of binders are a representative showing of binders, and not meant to encompass all binders. Those skilled in the art may recognize additional binders that may be sued within the scope of the invention.

Abrasive Particles

There are two main types of abrasive particles, inorganic abrasive particles and organic based particles. The inorganic abrasives particles can further be divided into hard inorganic abrasive particles (i.e., they have a Moh hardness greater than 8) and soft inorganic abrasive particles (i.e., they have a Mohs hardness less than 8). Examples of conventional hard abrasive particles include fused aluminum oxide, heat treated aluminum oxide, white fused aluminum oxide, black silicon carbide, green silicon carbide, titanium diboride, boron carbide, tungsten carbide, titanium carbide, diamond, cubic boron nitride, garnet, fused alumina zirconia, sol gel abrasive particles and the like. Examples of sol gel abrasive particles can be found in U.S. Pat. Nos. 4,314,827, 4,623,364; 4,744,802, 4,770,671; 4,881,951, all incorporated herein after by reference.

Examples of conventional softer inorganic abrasive particles include silica, iron oxide, chromia, ceria, zirconia, titania, silicates and tin oxide. Still other examples of soft abrasive particles include: metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays, (montmorillonite) feldspar, mica, calcium silicate, calcium metasilicate, sodium aluminosilicate, sodium silicate) metal sulfates (such as calcium sulfate, barium sulfate, sodium sulfate, aluminum sodium sulfate, aluminum sulfate), gypsum, aluminum trihydrate, graphite, metal oxides (such as calcium oxide (lime), aluminum oxide, titanium dioxide) and metal sulfites (such as calcium sulfite), metal particles (tin, lead, copper and the like) and the like.

The plastic abrasive particles can be formed from a thermoplastic material such as polycarbonate, polyetherimide, polyester, polyethylene, polysulfone, polystyrene, acrylonitrile-butadiene-styrene block copolymer, polypropylene, acetal polymers, polyvinyl chloride, polyurethanes, nylon and combinations thereof. In general, preferred thermoplastic polymers of the invention are those having a high melting temperature or good heat resistance properties. There are several ways to form a thermoplastic abrasive particle. One such method is to extrude the thermoplastic polymer into elongate segments and then cut these segments into the desired length. Alternatively, the thermoplastic polymer can be molded into the desired shape and particle size. This molding process can be compression molding or injection molding. The plastic abrasive particles can be formed from a crosslinked polymer. Examples of crosslinked polymers include: phenolic resins, aminoplast resins, urethane resins, epoxy resins, melamine-formaldehyde, acrylate resins, acrylated isocyanurate resins, urea-formaldehyde resins, isocyanurate resins, acrylated urethane resins, acrylated epoxy resins and mixtures thereof. These crosslinked polymers can be made, crushed and screened to the appropriate particle size and particle size distribution.

The abrasive article may also contain a mixture of two or more different abrasive particles. This mixture may comprise a mixture of hard inorganic abrasive particles and soft inorganic abrasive particles or a mixture of two soft abrasive particles. In the mixture of two or more different abrasive particles, the individual abrasive particles may have the same average particle size, or alternatively the individual abrasive particles may have a different average particle size. In yet another aspect, there may be a mixture of inorganic abrasive particles and organic abrasive particles.

The abrasive particle can be treated to provide a surface coating thereon. Surface coatings are known to improve the adhesion between the abrasive particle and the binder in the abrasive article. Additionally, the surface coating may also improve the dispersibility of the abrasive particles in the coating solution. Alternatively, surface coatings can alter and improve the cutting characteristics of the resulting abrasive particle.

Preferably, the abrasive particle used in the articles of the present invention is a silica particle. Silica is especially preferred when the article of the invention is to be used in the polishing of fiber optic connectors, as described herein. In some embodiments, the silica particle has a mean particle size diameter of less than 20 nanometers. In other embodiments, the silica particle has a mean particle size diameter of about 12 nanometers. The above mentioned examples of abrasive particles are meant to be a representative showing, and not meant to encompass all abrasive particles. Those skilled in the art may recognize additional abrasive particles that can be incorporated into the abrasive article within the scope of the invention.

Lubricating Particulate Additives

The lubricating particulate additive of the present invention is non-metallic materials, which are substantially solid at room temperature. Preferably, the lubricating particulate additive has a shear yield that is less than the shear yield of the materials in the end surface. For example, to polish a fiber optic connector, the lubricating particulate additive must have a shear yield lower than the shear yield of glass or ceramic. Some examples of suitable lubricating particulate additives are glycerides, waxes, and other polymers. Specifically, polytetrafluoroethylene, synthetic straight chain hydrocarbons, polyethylene, polypropylene and combinations of the same are adequate lubricating particulate additives. The lubricating particulate additive typically has a maximum size of less than 31 microns, preferably between 12 microns and 31 microns. The mean size of the lubricating particulate additive is typically less than 12 microns, preferably between 2 and 12 microns.

The lubricating particulate additive may form up to 20% (wet weight) of the coating. Preferably, the lubricating particulate additive composes less than 10% (wet weight), and more preferably less than 3.5% (wet weight). In certain embodiments, the lubricating particulate additive comprises between 0.25% (wet weight) and 2% (wet weight) of the coating while still achieving the goals of the present invention.

Optional Additives

Optional additives, such as, for example, fillers (including grinding aids), fibers, antistatic agents, lubricants, wetting agents, surfactants, pigments, dyes, coupling agents, plasticizers, release agents, suspending agents, and curing agents including free radical initiators and photoinitiators, may be included in the abrasive articles of the present invention. The optional additives may be included in the coating solution. These optional additives may further require that additional components be included in the coating solution composition to aid in curing; for example, a photoinitiator may be required when acrylates are used. The amounts of these materials can be selected to provide the properties desired.

For example, an abrasive article including a lubricating particulate additive can further include a wetting agent, preferably, an anionic surfactant, i.e., a surfactant capable of producing a negatively charged surface active ion. Preferable anionic surfactants are commercially available, such as "Interwet 33", a glycol ester of fatty acids, available from Interstab Chemicals, New Brunswick, N.J.; and "Emulon A", an ethoxylated oleic acid, available from BASF Corp., Mount Olive, N.J., to name a few. Preferably, the anionic surfactant is in an amount sufficient to allow for uniform wetting of the backing, the make coat bond system and the abrasive particles, more preferably about 0.5% by weight or less, even more preferably about 0.3% by weight or less, and most preferably about 0.2% by weight. The anionic surfactant may be premixed with the binder precursor, such as a phenolic resin, followed by adding the wax-containing modifier, such as those commercially available from Tirarco Chemical Co. under the trade designations "Octowax 695" (an aqueous, anionic emulsion of paraffin wax at 50% solids), "Octowax 437" (an aqueous, anionic emulsion of paraffin and microcrystallline waxes at 53% solids), and "Octowax 321" (an aqueous, anionic emulsion of paraffin wax at 50% solids).

Examples of useful fillers for this invention include: metal carbonates, such as calcium carbonate (chalk, calcite, marl, travertine, marble and limestone), calcium magnesium carbonate, sodium carbonate, magnesium carbonate; silica (such as quartz, glass beads, glass bubbles and glass fibers); silicates, such as talc, clays, montmorillonite, feldspar, mica, calcium silicate, calcium metasilicate, sodium aluminosilicate, sodium silicate; metal sulfates, such as calcium sulfate, barium sulfate, sodium sulfate, aluminum sodium sulfate, aluminum sulfate; gypsum; vermiculite; wood flour; aluminum trihydrate; carbon black; metal oxides, such as calcium oxide, aluminum oxide, titanium dioxide; and metal sulfites, such as calcium sulfite. Examples of useful fillers also include silicon compounds, such as silica flour, e.g., powdered silica having a particle size of from about 4 to 10 mm (available from Akzo Chemie America, Chicago, Ill.), and calcium salts, such as calcium carbonate and calcium metasilicate (available under the trade designations, "Wollastokup" and "Wollastonite" from Nyco Company, Willsboro, N.Y.).

Examples of antistatic agents include graphite, carbon black, vanadium oxide, humectants, and the like. These antistatic agents are disclosed in U.S. Pat. Nos. 5,061,294; 5,137,542; and 5,203,884.

A coupling agent can provide an association bridge between the binder and the filler particles. Additionally the coupling agent can provide an association bridge between the binder and the abrasive particles. Examples of coupling agents include silanes, titanates, and zircoaluminates. There are various means to incorporate the coupling agent. For example, the coupling agent may be added directly to the binder precursor. The binder may contain anywhere from about 0.01 to 3% by weight coupling agent. Alternatively, the coupling agent may be applied to the surface of the filler particles or the coupling agent may be applied to the surface of the abrasive particles prior to being incorporated into the abrasive article. The abrasive particles may contain anywhere from about 0.01 to 3% by weight coupling agent.

Curing agents such as an initiator may be used, for example, when the energy source used to cure or set a binder precursor is heat, ultraviolet light, or visible light in order to generate free radicals. Examples of curing agents such as photoinitiators that generate free radicals upon exposure to ultraviolet light or heat include organic peroxides, azo compounds, quinones, nitroso compounds, acyl halides, hydrazones, mercapto compounds, pyrylium compounds, imidazoles, ichlorotriazines, benzoin, benzoin alkyl ethers, diketones, phenones, and mixtures thereof.

The article of the present invention can be used to abrade and/or polish a wide range of contact surfaces. These contact surfaces include metal (including mild steel, carbon steel, stainless steel, gray cast iron, titanium, aluminum and the like), metal alloys (copper, brass and the like), exotic metal alloys, ceramics, glass, wood (including pine, oak, maple elm, walnut, hickory, mahogany, cherry and the like), wood like materials (including particle board, plywood, veneers and the like) composites, painted surface, plastics (including thermoplastics and reinforced thermoplastics), stones (including jewelry, marble, granite, and semi precious stones), glass surfaces including glass television screens, windows (including home windows, office windows, car windows, air windows, train windows, bus windows and the like); glass display shelves, mirrors and the like) and the like. The abrasive article may also be used to clean surfaces such as household items (including dishes, pots, pans and the like), furniture, walls, sinks, bathtubs, showers, floors and the like.

The contact surface may be flat or may have a shape or contour associated with it. Examples of specific contact surfaces include ophthalmic lenses, glass television screens, metal engine components (including cam shafts, crankshafts, engine blocks and the like), hand tools metal forgings, fiber optic connectors, furniture, wood cabinets, turbine blades, painted automotive components, bath tubs, showers, sinks, and the like.

Depending upon the particular application, the force exerted by the abrasive article on the contact surface at the abrading interface can range from about 0.01 kg to over 10 kg, typically between 0.1 to 5 kg. Preferably, the force at the abrading interface is about 0.1 kg to about 4 kg for abrading twelve ST style single mode UPC ceramic optical connectors (available from Minnesota Mining and Manufacturing Company, St. Paul, Minn. under part description AAMAM-AT00.5). Also depending upon the application, there may be a polishing liquid present at the interface between the abrasive article and the contact surface. This liquid can be water and/or an organic solvent. The polishing liquid may further comprise additives such as lubricants, oils, emusilified organic compounds, cutting fluids, soaps and the like. The abrasive article may oscillate at the polishing interface during use.

The abrasive article of the invention can be used by hand or used in combination with a machine. For example, the abrasive article may be secured to a random orbital tool or a rotary tool. At least one or both of the abrasive article and the contact surface is moved relative to the other.

The abrasive article of the invention has been found to be especially useful to polish a contact surface made of two different materials, each having a different hardness. An example is the polishing of the ends of a fiber optic connector, which has an end surface composed of glass and ceramic. The lubricating particulate additive provides a more uniform rate of polish for both the in the ceramic ferrule and the glass fiber so that both will abrade at the same rate, resulting in a highly polished fiber optic connector without severe undercut.

Additionally, prior methods have required in excess of three steps to grind and polish the fiber optic connector. The invention provides a polishing method that comprises pre-polishing the contact surface of a fiber optic connector by contacting the contact surface with a first abrasive article and relatively moving the fiber optic connector and the first abrasive article. Following pre-polishing, polishing the contact surface of the fiber optic connector is accomplished by contacting the contact surface with an article of the invention as herein described, and relatively moving the fiber optic connector and the polishing abrasive article to polish the contact surface of the fiber optic connector. In another embodiment, a second pre-polishing step may follow the pre-polishing step. The second pre-polishing step comprises contacting the contact surface with a second abrasive article and relatively moving the fiber optic connector and the second abrasive article. The second abrasive article may be different from the first abrasive article.

Using a polishing abrasive article in the form of a 5 inch (12.7 cm) diameter disk, the polishing step may be carried out on a known polishing machine such as a Domaille Model HDC 86792001L fiber optic polisher (Domaille Engineering, Inc. of Rochester, Minn.) which can accommodate 12 ST style single mode UPC ceramic connectors to polish the contact surfaces within about 15 to about 60 seconds on a 70 Durometer back-up pad. Using the Domaille machine, the force at the abrading interface is typically about 1 kg to about 4 kg, preferably about 1.5 kg to about 3 kg, and the speed setting is typically around 70% to 90%, preferably about 80% of maximum speed. Other suitable polishing machines include a Seiko Instruments Inc. OFL-12 (Seiko Instruments USA Inc., Torrance, Calif.) series mass production polisher using a 5 inch (12.7 cm) disk of the polishing abrasive article. The Seiko instrument can also polish 12 ST style single mode UPC ceramic connector contact surfaces within about 30 to about 180 seconds on position setting 1 or 2. The articles and polishing methods of the invention may also be used with other fiber optic connectors such as LC or MU fiber optic connectors, for example.

The present invention provides acceptable undercut/protrusion values and good polish in fewer steps. The undercut/protrusion values are also well within acceptable ranges of ±50 nanometers. The resultant fiber optic connectors also have good backreflection values after the present method. Typically, the backreflection will be better than −45 dB.

The abrasive article of the present invention is manufactured by applying a coating solution to a backing. The coating solution comprises a binder, abrasive particles, and a lubricating particulate additive comprising polytetrafluoroethylene. The coating solution is then solidified to provide the abrasive article. The coating solution may be applied to the backing by any suitable means for spreading a thin coat, such as by a knife coater, a spray coater, or a roll coater for example. The flowable coating solution is formed of a binder, abrasive particles, and a lubricating particulate additive. As discussed above, the binder, abrasive and lubricating particulate additive may be any of a number of materials described herein. The coating solution may have a composition of about 1% to about 14% (wet weight) phenoxy resin, about 0% to about 5% (wet weight) isocyanate, about 0% to about 7% (wet weight) polyester urethane resin, about 7% to 11% (wet weight) toluene, about 74% to about 87% (wet weight) silica abrasive particles and about 0.3% to about 4% (wet weight) lubricating particulate additive.

After it is applied to the backing, the coating solution composition may be solidified by curing in an oven at temperatures of about 93° C. (200° F.) to about 135° C. (275° F.), preferably about 121.1° C. (250° F.) for 15 minutes and then 12 hours at about 52° C. (125° F.) to about 99° C. (210° F.), preferably about 73.9° C. (165° F.). The coating solution composition may also be solidified in a hot box oven in stages, for example four stages. A first stage may have temperatures of about 66° C. (150° F.) to about 93° C. (200° F.), preferably 90° C. (194° F.) for about 0.3 minutes to about 1.5 minutes, preferably 0.7 minutes. The second stage may have about 52° C. (125° F.) to about 79.4° C.

(175° F.), preferably 73.9° C. (165° F.) for about 0.3 minutes to about 1.5 minutes, preferably 0.7 minutes. A third stage may have about 93° C. (200° F.) to about 135° C. (275° F.), preferably 112.2° C. (234° F.) for about 1.5 minutes to about 3 minutes, preferably 2.1 minutes. A fourth stage may have and about 93° C. (200° F.) to about 135° C. (275° F.), preferably 111.7° C. (233° F.) for about 0.3 minutes to about 1.5 minutes, preferably 0.7 minutes. The coated abrasive web may be cut (e.g., by die cutting) into a desired configuration such as a 5 inch (12.7 cm) diameter disk. Other configurations for the final article may be desired and are contemplated by as within the scope of the invention.

EXAMPLES

Additional features of the preferred embodiment are illustrated in the following Examples. Unless otherwise indicated, all parts and percentages are by weight.

Materials

Lubricating particulate additives used in the following Examples are described according to their trade designations in Table 1. All were obtained from Micro Powders, Incorporated of Tarrytown, N.Y. The mean particle sizes and maximum particle sizes for the lubricating particulate additive are also reported.

TABLE 1

Lubricating Particulate Additives

| Additive designation | Mean Size (micron) | Maximum Size (micron) | Type |
|---|---|---|---|
| Fluo HT | 2–4 | 12 | polytetrafluoroethylene |
| MP-22XF | 4.5–5.5 | 22 | hydrocarbon |
| MPP-620VF | 5–7 | 22 | polyethylene |
| Polyfluo 523XF | 2.5–5.5 | 15.6 | polyethylene and polytetrafluoroethylene |
| Propylmatte 31 | 8–12 | 31 | polypropylene |
| Superslip 6530 | 6–8 | 22 | wax polymers |
| Synfluo 178VF | 5–7 | 22 | hydrocarbon and polytetrafluoroethylene |

Other materials used in the manufacture of polishing film according to the Examples are referred to using the following designations:

Nalco 1057 is the trade designation for a colloidal silica (a 20 nanometer colloidal silica dispersed at 30% solids in 2-propoxyethanol) obtained from Nalco Chemical Company, Naperville, Ill.

MEK-ST is the trade designation for a colloidal silica (a 12 nanometer colloidal silica dispersed at 30% solids in 2-butanone) obtained from Nissan Chemical Industries, LTD., Houston, Tex.

YP-50S is the trade designation for a solid phenoxy resin obtained from Tohto Kasei Co. Ltd., Inabata America Corporation, New York, N.Y. which was dissolved at 30% solids in 2-butanone prior to use herein.

PUR is a polyester urethane resin prepared from 6% by weight neopentyl glycol, 31% by weight 4,4'-diphenyl methane diisocyanate (MDI), and 63% by weight poly-ε-caprolactone. The equivalent weight of the polymer is 10,000. PUR is 25% solids in 2-butanone.

CB55N is the trade designation for a isocyanate resin comprising 55% solids in 2-butanone and was obtained from Bayer Corporation of Pittsburgh, Pa.

DTD Catalyst is a dibutyl tin dilaurate catalyst obtained from Autofina of Philadelphia, Pa.

2-Butanone, used as a solvent, was obtained under catalog number EM-BX1673-1 from VWR Scientific Products of Chicago, Ill.

Toluene, used as a solvent, was obtained under catalog number EM-TX0737-1 from VWR Scientific Products of Chicago, Ill.

Backing 1 is a primed 3 mil (76 micron) polyester backing prepared according to the teachings of Canty and Jones, EP 206669A. The backing used was 6 inches (15.24 cm) wide.

Backing 2 is a primed 3 mil (76 micron) polyester backing obtained from Teijin America of Atlanta, Ga. under the trade designation Teijin SG2. The backing used was 14 inches (35.56 cm) wide.

Examples 1–7

Polishing films of Examples 1–7 were made for testing using the coating solution compositions described in Table 2. In all of the coating solution compositions, 42.2 parts of Nalco 1057 silica were mixed for 5 minutes with 0.8 parts of a lubricating particulate additive (see Table 1). The mixing was accomplished using a ½ hp (372 watt) air mixer of the type commercially available from VWR Scientific Products, Chicago, Ill., using a 1.5 inch (3.8 cm) diameter serrated mixing blade at 1500 rotations per minute (RPM). After 5 minutes of mixing, 7.5 parts of YP-50S phenoxy resin solution were added while continuing to mix for an additional 5 minutes. All coating solution compositions were approximately 37% solids.

TABLE 2

Coating Solution Compositions (Examples 1–7)

| Ingredient | Example 1 | Example 2 | Example 3 | Example 4 | Example 5 | Example 6 | Example 7 |
|---|---|---|---|---|---|---|---|
| Nalco 1057 | 42.2 | 42.2 | 42.2 | 42.2 | 42.2 | 42.2 | 42.2 |
| Fluo HT | 0.8 | — | — | — | — | — | — |
| MP-22XF | — | 0.8 | — | — | — | — | — |
| MPP-620VF | — | — | 0.8 | — | — | — | — |
| Polyfluo 523XF | — | — | — | 0.8 | — | — | — |
| Propylmatte 31 | — | — | — | — | 0.8 | — | — |
| Superslip 6530 | — | — | — | — | — | 0.8 | — |
| Synfluo 178VF | — | — | — | — | — | — | 0.8 |
| YP-50S phenoxyresin | 7.5 | 7.5 | 7.5 | 7.5 | 7.5 | 7.5 | 7.5 |

The coating solution compositions were then used to make polishing films. Each of the coating solution compositions were applied to a corona treated primed side of Backing 1 using a knife coater. The backing was 6 inches (15.24 cm) wide. The primed side was corona treated prior to the application of the coating solution composition at 60% output current, 95% output voltage with a power meter reading of 0.57 KW. The corona treater was a Pillar 12 inch cantilever EZ thread model equipped with a Model P1007 power control and a Model HV XEMER power supply (commercially available from Pillar Technologies Limited Partnership, Hartland, Wis.). The coating was between 0.05 to 0.25 mils in thickness. All samples were cured at approximately 250° F. (121° C.) for 15 minutes and then 12 hours at 165° F. (74° C.) in an oven. The abrasive web was then cut into 5 inch (12.7 cm) diameter disks.

Examples 8–10

Polishing films of Examples 8, 9 and 10 were made using the coating solution compositions formulated as described in Table 3. Prior to the preparation of the coating solution compositions, a 4:1 premix of 200 parts of MEK-ST silica and 50 parts of Fluo HT additive were attritor milled in a 600 ml stainless steel beaker at 750 RPM using 750 parts of ER 120S 1.25/1.6 mm zirconia silicate bead media (available from Sepr Ceramics of Mountainside, N.J.) for 60 minutes.

The coating solution composition of Example 8 was prepared by mixing 65.5 parts of MEK-ST silica with 10.3 parts of toluene, 3.3 parts of YP-50S phenoxy resin, and 2.7 parts of PUR for 5 minutes. The mixing was accomplished using a ½ hp air mixer of the type available from VWR Scientific Products of Chicago, Ill. and equipped with a 1.5 inch diameter serrated mixing blade rotating at a rate of 1500 RPM. The container used for mixing was also sonicated in a Branson 1210 sonic bath (Branson Ultrasonics Corporation of Danbury, Conn.) while mixing the coating solution. The solution was filtered through a 5 micron filter. After filtration, 2.5 parts of the 4:1 Fluo HT premix (Fluo HT additive and MEK-ST silica) were added while continuing to mix for an additional 5 minutes with sonication. 1.7 parts of CB55N resin were added with continued mixing and sonication for 5 minutes. Finally, 0.25 parts of DTD catalyst were added with continued mixing and sonication for 5 minutes. The abrasive coating solution was approximately 30% solids.

The coating solution compositions of Examples 9 and 10 were prepared as in Example 8, but changing the quantities of MEK-ST silica, toluene, and 4:1 Fluo HT premix as indicated in Table 3. The abrasive coating solutions were approximately 30% solids.

TABLE 3

Coating Solution Compositions (Examples 8–10)

| Ingredient | Example 8 | Example 9 | Example 10 |
|---|---|---|---|
| MEK-ST silica | 65.5 | 63.5 | 88.0 |
| Toluene | 10.3 | 10.3 | 11.8 |
| YP-50S phenoxy resin | 3.3 | 3.3 | 3.3 |
| PUR | 2.7 | 2.7 | 2.7 |
| 4:1 Fluo HT premix | 2.5 | 5.0 | 2.5 |
| CB55N resin | 1.7 | 1.7 | 1.7 |
| DTD catalyst, 10% in 2-butanone | 0.25 | 0.25 | 0.25 |

The coating solution compositions were used to make the final polishing films. Each of the compositions were applied to a primed side of a Backing 2 using a knife on roll coater. Backing 2 was 14 inches (35.56 cm) wide. The coating produced was between 0.05 to 0.25 mils in thickness. The samples were cured in a hot box oven with zone 1 at approximately 194° F. (90° C.) for 0.7 minutes. Zone 2 was at approximately 165° F. (74° C.) for 0.7 minutes, zone 3 at approximately 234° F. (112° C.) for 2.1 minutes, and zone 4 was at approximately 233° F. (112° C.) for 0.7 minutes. The coated abrasive web was then cut into 5 inch (12.7 cm) diameter disks.

Polishing Method 1 (Examples 1–7)

Polishing films of Examples 1 through 7 were each evaluated by polishing a different set of twelve ST style single mode UPC ceramic optical connectors (connectors were obtained from Minnesota Mining and Manufacturing Company, St. Paul, Minn. under part description AAMAM-AT00.5) on a Domaille Model HDC 86792001L fiber optic polisher (Domaille Engineering, Inc. of Rochester, Minn.) using a 5 inch (12.7 cm) disk of polishing film. Protrusion/undercut values were measured before and after the final polish film step using a Wyko Vision 32 fiber optic interferometer (Veeco Metrology Group of Tucson, Ariz.). Backreflection values were measured using a JDS Fitel backreflection meter model RM3000A (available from JDS Fitel Inc. of Ontario, Canada).

The polishing sequence for conditioning the connectors prior to a final polish step consisted of three steps. In each successive step, a different grade of lapping film was used. The first step was accomplished using a 3M 462X IMPERIAL™ Lapping Film, 3 micron silicon carbide (available from the Minnesota Mining and Manufacturing Company of St. Paul, Minn.) 5 inch (12.7 cm) disk for 15 seconds on a 70 durometer back-up pad with 8 lbs. (3 kg) of polishing force at a speed setting of 80%. The second step was accomplished using a 3M 661X IMPERIAL™ Diamond Lapping Film, 1 micron diamond (also from Minnesota Mining and Manufacturing Company) 5 inch (12.7 cm) disk for 30 seconds on a 70 durometer back-up pad with 8 lbs. (3 kg) of polishing force at a speed setting of 80%. The third step was accomplished using a 3M 263X IMPERIAL™ Lapping Film, 0.05 micron aluminum oxide type P (also from Minnesota Mining and Manufacturing Company) 5 inch (12.7 cm) disk for 60 seconds on a 70 durometer back-up pad with 8 lbs. (3 kg) of polishing force at a speed setting of 80%.

The conditions for the final polish step using the polishing films prepared in Examples 1–7 was 60 seconds on a 70 durometer back-up pad with 8 lbs (3 kg) of polishing force at a speed setting of 80%.

The average values for protrusion/undercut before the final polish step, the average values for protrusion/undercut after the final polish step, and the average values for backreflection after the final polish step are reported in the following Table 4. The average values were determined by averaging readings from four of the optical connectors. The test lead in the backreflection meter was initially clean, but became fouled during use from scratches and other flaws caused by the contact with the fiber optic connectors. Consequently, these backreflection values are lower than with a clean backreflection connector test lead, but indicate that the polished connectors are without gross flaws such as scratches or pitting that is visible under 400× magnification, resin transfer, and resin smearing on the polished end.

TABLE 4

Protrusion/Undercut and Average Back Reflection Values (Examples 1–7)

| Example | Additive | Average Protrusion/ Undercut Before Final Polish (nanometers) | Average Protrusion/ Undercut After Final Polish (nanometers) | Average Back-reflection After Final Polish (db) |
|---|---|---|---|---|
| 1 | Fluo HT | −103.2 | 16.9 | −48.9 |
| 2 | MP-22XF | −87.5 | 27.8 | −50.4 |

TABLE 4-continued

Protrusion/Undercut and Average Back Reflection Values (Examples 1–7)

| Example | Additive | Average Protrusion/ Undercut Before Final Polish (nanometers) | Average Protrusion/ Undercut After Final Polish (nanometers) | Average Back-reflection After Final Polish (db) |
|---|---|---|---|---|
| 3 | MPP-620VF | −81.8 | 49.3 | −50.1 |
| 4 | Polyfluo 523XF | −82.9 | 26.5 | −47.4 |
| 5 | Propylmatte 31 | −84.8 | 18.6 | −48.8 |
| 6 | Superslip 6530 | −85.6 | 22.7 | −51.3 |
| 7 | Synfluo 178VF | −84.7 | 23.6 | −50.6 |

Polishing Method 2 (Examples 8–10, Comparative Example A)

The polishing films of Examples 8–10 and Comparative Example A were evaluated by polishing twelve ST style single mode UPC ceramic optical connectors (connectors were obtained from Minnesota Mining and Manufacturing Company, St. Paul, Minn. under part description AAMAM-AT00.5) on a Domaille Model HDC 86792001L fiber optic polisher (Domaille Engineering, Inc. of Rochester, Minn.) using a 5 inch (12.7 cm) diameter disk of polishing film. The protrusion/undercut values were measured before and after the final polish film step using a Wyko Vision 32 fiber optic interferometer (Veeco Metrology Group of Tucson, Ariz.). Backreflection values were measured using a JDS Fitel backreflection meter model RM3000A (JDS Fitel Inc., Ontario, Canada).

The polishing sequence for the conditioning of the connectors prior to the final polish step consisted of two steps. The first step was accomplished using a 3M 462X IMPERIAL™ Lapping Film, 3 micron silicon carbide (available from Minnesota Mining and Manufacturing, St. Paul, Minn.) 5 inch (12.7 cm) disk for 25 seconds on a 70 durometer back-up pad with 8 lbs. (3 kg) of polishing force at a speed setting of 80%.

The second step was accomplished using a 3M 661X IMPERIAL™ Diamond Lapping Film, 1 micron diamond (also from Minnesota Mining and Manufacturing Company) 5 inch (12.7 cm) disk for 15 seconds on a 70 durometer back-up pad with 8 lbs. (3 kg) of polishing force at a speed setting of 80%. The conditions for the final polish step using the polishing films prepared in examples 8 through 10 was 25 seconds on a 70 durometer back-up pad with 4 lbs. (1.5 kg) of polishing force at a speed setting of 80%.

Comparative Example A was a 3M 263X IMPERIAL™ Lapping Film, 0.05 micron aluminum oxide type P (available from Minnesota Mining and Manufacturing Company, St. Paul, Minn.) 5 inch (12.7 cm) disk which was used in a comparison with the polishing films of Examples 8–10. This is a lapping film having an aluminum oxide abrasive instead of the silica abrasive particle in the present invention. It also did not have a lubricating particulate additive. However, with those exceptions, Comparative Example A is formed of the same materials as Examples 8–10. The polishing conditions for Comparative Example A were 25 seconds on a 70 durometer back-up pad with 4 lbs. (1.5 kg) of polishing force at a speed setting of 80%.

The average values for protrusion/undercut before the final polish step, the average values for protrusion/undercut after the final polish step, and the average values for backreflection after the final polish step are reported in Table 5. Each pad was used three consecutive times on different groups of fiber optic connectors. The average values were determined by averaging readings from four of the optical connectors. These backreflection values are lower than with a clean backreflection connector test lead, but indicate that the polished connectors are without gross flaws such as scratches or pitting that is visible under 400× magnification, resin transfer, and resin smearing on the polished end. Example 9' is made of the same formulation as Example 9, however the backreflection measurements were made with a clean test lead. Each pad was used three consecutive times on different groups of fiber optic connectors.

TABLE 5

Protrusion/Undercut, Back Reflection Values for Polishing Method 2

| Example | Number of Uses | Average Protrusion/Undercut Before Final Polish (nanometers) | Average Protrusion/ Undercut After Final Polish (nanometers) | Average Backreflection After Final Polish (db) |
|---|---|---|---|---|
| 8 | 1st | 15.1 | 16.1 | −48.6 |
| 8 | 2nd | 18.6 | 12.4 | −48.3 |
| 8 | 3rd | 16.1 | 2.6 | −48.4 |
| 9 | 1st | 11.9 | 15.8 | −48.3 |
| 9 | 2nd | 17.2 | 8.3 | −47.6 |
| 9 | 3rd | 14.0 | −2.0 | −48.2 |
| 9' | 1st | 17.8 | 10.2 | −56.1 |
| 9' | 2nd | 13.9 | 23.5 | −55.5 |
| 9' | 3rd | 18.4 | 12.7 | −55.5 |
| 10 | 1st | 14.3 | 21.6 | −48.2 |
| 10 | 2nd | 18.1 | 21.0 | −47.8 |
| 10 | 3rd | 15.7 | 16.0 | −47.6 |
| Comp. Ex. A | 1st | 17.3 | −91.0 | −44.7 |

Polishing Method 3 (Examples 8–10, Comparative Example A)

The polishing films of Examples 8–10 and Comparative Example A were evaluated by polishing twelve ST style single mode UPC ceramic optical connectors (connectors were obtained from Minnesota Mining and Manufacturing Company, St. Paul, Minn. under part description AAMAM-AT00.5) on a Domaille Model HDC 86792001L fiber optic polisher (available from Domaille Engineering, Inc., Rochester, Minn.) using a five inch disk of polishing film. The protrusion/undercut values were measured before and after the final polish film step using a Wyko Vision 32 fiber optic interferometer (available from Veeco Metrology Group, Tucson, Ariz.). Backreflection values were measured using a JDS Fitel backreflection meter model RM3000A (available from JDS Fitel Inc., Ontario, Canada).

The polishing sequence for the conditioning of the connectors prior to the final polish step consists of two steps. The first step was accomplished using a 3M 462X IMPERIAL™ Lapping Film, 3 micron silicon carbide (available from Minnesota Mining and Manufactory Company, St. Paul, Minn.) 5 inch (12.7 cm) disk for 25 seconds on a 70 durometer back-up pad with 8 lbs (3 kg) of polishing force at a speed setting of 80% . The second step was accomplished using a 3M 661X IMPERIAL™ Diamond Lapping Film, 1 micron diamond (also from Minnesota Mining and Manufacturing Company) 5 inch (12.7 cm) disk for 15 seconds on a 70 durometer back-up pad with 8 lbs. (3 kg) of polishing force at a speed setting of 80%.

The conditions for the final polish step using the polishing films of Examples 8–10 was 25 seconds on a 70 durometer back-up pad with 8 lbs (3 kg) of polishing force at a speed setting of 80%. The conditions for the final polish step using the polishing film of Comparative Example A was 25 seconds on a 70 durometer back-up pad with 8 lbs. (3 kg) of polishing force at a speed setting of 80%.

The average values for protrusion/undercut before the final polish step, the average values for protrusion/undercut after the final polish step, and the average values for backreflection after the final polish step are reported in Table 6. Each pad was used three consecutive times on different groups of fiber optic connectors. The average values were determined by averaging readings from four of the optical connectors. These backreflection values are lower than with a clean backreflection connector test lead, but indicate that the polished connectors are without gross flaws such as scratches or pitting that is visible under 400× magnification, resin transfer, and resin smearing on the polished end.

TABLE 6

Protrusion/Undercut and Back Reflection Values for Polishing Method 3

| Example | Number of Uses | Average Protrusion/Undercut Before Final Polish (nanometers) | Average Protrusion/ Undercut After Final Polish (nanometers) | Average Backreflection After Final Polish (db) |
|---|---|---|---|---|
| 8 | 1st | 11.9 | 17.4 | −48.9 |
| 8 | 2nd | 7.1 | 4.5 | −47.7 |
| 8 | 3rd | 17.1 | 15.0 | −48.0 |
| 9 | 1st | 15.3 | 21.3 | −48.4 |
| 9 | 2nd | 12.9 | 12.6 | −47.8 |
| 9 | 3rd | 17.7 | 12.6 | −48.2 |
| 10 | 1st | 12.8 | 26.3 | −48.5 |
| 10 | 2nd | 17.0 | 15.4 | −48.2 |
| 10 | 3rd | 15.1 | 21.2 | −48.8 |
| Comp. Ex. A | 1st | 13.8 | −100.2 | −47.1 |

Polishing Method 4 (Examples 8–10, Comparative Example A)

The polishing films of Examples 8–10 and Comparative Example A were evaluated by polishing twelve ST style single mode UPC ceramic optical connectors (connectors were obtained from Minnesota Mining and Manufacturing Company, St. Paul, Minn. under part description AAMAM-AT00.5) on a Seiko Instruments Inc. OFL-12 series mass production polisher (available from Seiko Instruments USA Inc., Torrance, Calif.) using a 5 inch (12.7 cm) disk of polishing film. The protrusion/undercut values were measured before and after the final polish film step using a Wyko Vision 32 fiber optic interferometer (available from Veeco Metrology Group, Tucson, Ariz.). Backreflection values were measured using a JDS Fitel backreflection meter model RM3000A (JDS Fitel Inc., Ontario, Canada).

The polishing sequence for the conditioning of the connectors prior to the final polish step consisted of two steps The first step was accomplished using a 3M 462X IMPERIAL™ Lapping Film, 3 micron silicon carbide (Minnesota Mining and Manufacturing Company, of St. Paul, Minn.) 5 inch (12.7 cm) disk for 60 seconds on position setting 2. The second step was accomplished using a 3M 661X IMPERIAL™ Diamond Lapping Film, 1 micron diamond (also from Minnesota Mining and Manufacturing Company) 5 inch (12.7 cm) disk for 60 seconds on position setting 2. The final polish step using the polishing films of Examples 8–10 was accomplished in 240 seconds on position setting 1. The final polish step for the polishing film of Comparative Example A was accomplished in 240 seconds on position setting 1.

The average values for protrusion/undercut before the final polish step, the average values for protrusion/undercut after the final polish step, and the average values for backreflection after the final polish step are reported in Table 7. Each pad was used three consecutive times on different groups of fiber optic connectors. The average values were determined by averaging readings from four of the optical connectors. These backreflection values are lower than with a clean backreflection connector test lead, but indicate that the polished connectors are without gross flaws such as scratches or pitting that is visible under 400× magnification, resin transfer, and resin smearing on the polished end.

TABLE 7

Protrusion/Undercut and Back Reflection Values for Polishing Method 4

| Example | Number of Uses | Average Protrusion/Undercut Before Final Polish (nanometers) | Average Protrusion/ Undercut After Final Polish (nanometers) | Average Backreflection After Final Polish (db) |
|---|---|---|---|---|
| 8 | 1st | 4.1 | 13.1 | −48.2 |
| 8 | 2nd | 5.2 | 12.4 | −47.2 |
| 8 | 3rd | 3.5 | −0.5 | −48.2 |
| 9 | 1st | 6.3 | 13.3 | −48.3 |
| 9 | 2nd | 4.3 | 7.4 | −47.6 |
| 9 | 3rd | 9.3 | 15.5 | −48.8 |
| 10 | 1st | 0.6 | 16.3 | −47.2 |
| 10 | 2nd | 6.1 | −1.5 | −48.1 |
| 10 | 3rd | 4.3 | −9.9 | −47.4 |
| Comp. Ex. A | 1st | 2.7 | −115.6 | −45.9 |

Polishing Method 5 (Examples 8–10, Comparative Example A)

The polishing films of Examples 8–10 and Comparative Example A were evaluated by polishing twelve ST style single mode UPC ceramic optical connectors (connectors were obtained from Minnesota Mining and Manufacturing Company, St. Paul, Minn. under part description AAMAM-AT00.5) on a Seiko Instruments Inc. OFL-12 series mass production polisher (Seiko Instruments USA Inc., Torrance, Calif.) using a 5 inch (12.7 cm) disk of polishing film. The protrusion/undercut values were measured before and after the final polish film step using a Wyko Vision 32 fiber optic interferometer (Veeco Metrology Group, Tucson, Ariz.). Backreflection values were measured using a JDS Fitel backreflection meter model RM3000A (JDS Fitel Inc, Ontario, Canada.

The polishing sequence for the conditioning of the connectors prior to the final polish step consisted of two steps The first step was accomplished using a 3M 462X IMPERIAL™ Lapping Film, 3 micron silicon carbide (Minnesota Mining and Manufacturing Company, St. Paul, Minn.) 5 inch (12.7 cm) disk for 60 seconds on position setting 2. The second step was accomplished using a 3M 661X IMPERIAL™ Diamond Lapping Film, 1 micron diamond (also from Minnesota Manufacturing Company) 5 inch (12.7 cm) disk for 60 seconds on position setting 2.

The conditions for the final polish step using the polishing films of Examples 8–10 was 240 seconds on position setting 2. The conditions for the final polish step using the polishing film of Comparative Example A was 240 seconds on position setting 2.

The average values for protrusion/undercut before the final polish step, the average values for protrusion/undercut after the final polish step, and the average values for backreflection after the final polish step are reported in Table 8. Each pad was used three consecutive times on different groups of fiber optic connectors. The average values were determined by averaging readings from four of the optical connectors. These backreflection values are lower than with a clean backreflection connector test lead, but indicate that the polished connectors are without gross flaws such as scratches or pitting that is visible under 400× magnification, resin transfer, and resin smearing on the polished end.

TABLE 8

Protrusion/Undercut and Back Reflection Values for Polishing Method 5

| Example | Number of Uses | Average Protrusion/Undercut Before Final Polish (nanometers) | Average Protrusion/ Undercut After Final Polish (nanometers) | Average Backreflection After Final Polish (db) |
|---|---|---|---|---|
| 8 | 1st | 2.9 | 7.1 | −48.6 |
| 8 | 2nd | 4.2 | −4.9 | −47.3 |
| 8 | 3rd | 5.6 | 6.3 | −47.6 |
| 9 | 1st | 1.9 | 5.8 | −47.6 |
| 9 | 2nd | 12.8 | −31.0 | −47.6 |
| 9 | 3rd | 1.0 | −19.7 | −47.9 |
| 10 | 1st | −2.5 | 14.1 | −47.7 |
| 10 | 2nd | −0.3 | −43.4 | −48.0 |
| 10 | 3rd | 2.7 | −11.2 | −47.6 |
| Comp. Ex. A | 1st | 0.1 | −95.3 | −47.8 |

While the preferred embodiment has been described in detail herein, those skilled in the art will appreciate that changes can be made to such embodiments without departing from the true scope and spirit of the invention, as further described in the appended claims.

What is claimed is:

1. A method of abrading a fiber optic connector having a contact surface composed of glass and ceramic comprising:

pre-polishing the end of the fiber optic connector by contacting the contact surface with a first abrasive article and relatively moving the fiber optic connector and the first abrasive article;

polishing the end of the fiber optic connector by contacting the contact surface with a polishing abrasive article comprising a backing having a surface and a coating on the surface, the coating comprising a binder, abrasive particles associated with the binder, and a lubricating particulate additive associated with the binder; and relatively moving the fiber optic connector and the polishing abrasive article to polish the end of the fiber optic connector.

2. The method of claim 1 further comprising after the pre-polishing step, contacting the contact surface with a second abrasive article and relatively moving the fiber optic connector and the second abrasive article, the second abrasive article being different from the first abrasive article.

3. The method of claim 1 wherein the polishing step is carried out to polish the contact surface so that the protrusion or undercut is within ±50 nanometers.

4. The method of claim 1, wherein the abrasive particles are silica abrasive particles having a size no greater than 20 nanometers.

5. The method of claim 4, wherein the silica abrasive particles have a size no greater than about 12 nanometers.

6. The method of claim 1, wherein the lubricating particulate additive has a maximum size between 12 microns and 31 microns.

7. The method of claim 1, wherein the lubricating particulate additive has a mean size between 2 microns and 12 microns.

8. The method of claim 1, wherein the coating has a thickness of less than 13 microns.

9. The method of claim 1 wherein the lubricating particulate additive comprises a material selected from the group consisting of polytetrafluoroethylene, synthetic straight chain hydrocarbon, polyethylene, polypropylene and combinations thereof.

10. The method of claim 1 wherein the backing comprises a polyester film.

11. The method of claim 1 wherein the binder comprises an organic binder capable of forming a film.

12. The method of claim 1 wherein the organic binder comprises a material selected from the group consisting of phenoxy resin, isocyanate resin, polyester urethane resin and combinations thereof.

13. The method of claim 12 wherein the organic binder comprises a combination of about 43% wet weight of phenoxy resin, 22% wet weight isocyanate resin, and 35% wet weight polyester urethane resin.

14. The method of claim 1 wherein the backing comprises a polyester film, the binder comprises a combination of phenoxy resin, isocyanate resin and polyester urethane resin, the abrasive particles comprise silica abrasive particles and the lubricating particulate additives comprise polytetrafluoroethylene.

15. The method of claim 14 wherein the lubricating particulate additives have a maximum size of 12 microns and a mean size of between 2 microns and 4 microns.

16. The method of claim 1 wherein the polishing step is carried out to polish the contact surface so that the protrusion or undercut is within ±50 nanometers.

17. The method of claim 1, wherein the abrasive particles are silica abrasive particles having a size no greater than 20 nanometers.

18. The method of claim 1 wherein the organic binder comprises a material selected from the group consisting of phenoxy resin, isocyanate resin, polyester urethane resin and combinations thereof.

19. The method of claim 1 wherein the backing comprises a polyester film, the binder comprises a combination of phenoxy resin, isocyanate resin and polyester urethane resin, the abrasive particles comprise silica abrasive particles and the lubricating particulate additives comprise polytetrafluoroethylene.

20. A method of abrading a fiber optic connector having a contact surface composed of glass and ceramic comprising:

pre-polishing the end of the fiber optic connector by contacting the contact surface with a first abrasive article and relatively moving the fiber optic connector and the first abrasive article;

polishing the end of the fiber optic connector by contacting the contact surface with a polishing abrasive article comprising a backing having a surface and a coating on the surface, the coating comprising a binder, abrasive particles associated with the binder, and a lubricating particulate additive associated with the binder, wherein the lubricating particulate additive comprises a material selected from the group consisting of polytetrafluoroethylene, polyethylene, polypropylene, and combinations thereof; and relatively moving the fiber optic connector and the polishing abrasive article to polish the end of the fiber optic connector.

* * * * *

UNITED STATES PATENT AND TRADEMARK OFFICE

CERTIFICATE OF CORRECTION

PATENT NO. : 6,758,727 B2
DATED : July 6, 2004
INVENTOR(S) : Coad, Eric C.

It is certified that error appears in the above-identified patent and that said Letters Patent is hereby corrected as shown below:

Column 6,
Line 25, after "thereof" insert -- . --.

Column 18,
Line 55, delete "Manufactory" and insert in place thereof -- Manufacturing --.

Column 20,
Line 46, after "Canada" insert -- ) --.

Signed and Sealed this

Nineteenth Day of October,2004

JON W. DUDAS
*Director of the United States Patent and Trademark Office*